US006172289B1

(12) United States Patent
Shelley

(10) Patent No.: US 6,172,289 B1
(45) Date of Patent: Jan. 9, 2001

(54) DRUM HEAD HAVING AUXILIARY SOUND PRODUCING DEVICES

(75) Inventor: Thomas W. Shelley, Columbiana, OH (US)

(73) Assignee: Universal Percussion, Inc., Columbiana, OH (US)

( * ) Notice: Under 35 U.S.C. 154(b), the term of this patent shall be extended for 0 days.

(21) Appl. No.: 09/398,223

(22) Filed: Sep. 21, 1999

Related U.S. Application Data

(63) Continuation of application No. 09/225,060, filed on Jan. 4, 1999.

(60) Provisional application No. 60/070,429, filed on Jan. 5, 1998.

(51) Int. Cl.[7] ..... G10D 13/02

(52) U.S. Cl. ..... 84/411 R; 84/723; 84/730

(58) Field of Search ..... 84/723, 725, 730, 84/DIG. 24, 411 R

(56) References Cited

U.S. PATENT DOCUMENTS

| | | | | |
|---|---|---|---|---|
| 478,611 | | 7/1892 | Knittel . | |
| 627,766 | | 6/1899 | Wilken . | |
| 1,252,878 | | 1/1918 | Bower . | |
| 1,446,327 | | 2/1923 | Baldwin et al. . | |
| 2,565,225 | * | 8/1951 | Gladstone | 84/411 |
| 2,604,001 | | 7/1952 | Lewan . | |
| 3,026,759 | * | 3/1962 | Kleiner et al. | 84/411 |
| 3,136,201 | * | 6/1964 | Lang et al. | 84/411 |
| 3,261,253 | | 7/1966 | Ulano . | |
| 3,368,442 | * | 2/1968 | Wilcoxon | 84/411 |
| 3,509,264 | | 4/1970 | Green . | |
| 3,680,423 | | 8/1972 | Lander . | |
| 4,026,185 | * | 5/1977 | Migirian | 84/411 R |
| 4,077,297 | * | 3/1978 | Woodson | 84/411 R |
| 4,095,505 | | 6/1978 | Hoey et al. . | |
| 4,154,137 | * | 5/1979 | Kobayashi | 84/411 R |
| 4,168,646 | * | 9/1979 | May | 84/1.14 |
| 4,242,937 | | 1/1981 | Pozar . | |
| 4,244,266 | * | 1/1981 | Hardy | 84/411 M |
| 4,254,685 | * | 3/1981 | Rose | 84/414 |
| 4,279,188 | * | 7/1981 | Scott | 84/1.14 |
| 4,325,281 | * | 4/1982 | Hardy | 84/411 M |
| 4,362,081 | | 12/1982 | Hartry . | |
| 4,469,001 | | 9/1984 | Harty . | |
| 4,577,541 | * | 3/1986 | Edge | 84/411 R |
| 4,616,552 | * | 10/1986 | Jang | 84/414 |
| 4,742,753 | * | 5/1988 | Speed | 84/414 |
| 4,805,514 | | 2/1989 | Billings . | |
| 4,979,422 | * | 12/1990 | Bellli | 84/414 |
| 4,984,498 | * | 1/1991 | Fishman | 84/730 |
| 5,042,356 | | 8/1991 | Karch . | |
| 5,056,403 | * | 10/1991 | Yamashita | 84/723 |
| 5,115,706 | * | 5/1992 | Aluisi | 84/723 |
| 5,583,307 | * | 12/1996 | Tobia, Jr. | 84/411 R |
| 6,072,112 | * | 4/2000 | Suenaga et al. | 84/422.3 |

* cited by examiner

*Primary Examiner*—Robert E. Nappi
*Assistant Examiner*—Kim Lockett
(74) *Attorney, Agent, or Firm*—Vickers, Daniels & Young

(57) ABSTRACT

A drum head for a drum made of a natural and/or synthetic material or composite material which is designed to be attached to a drum head rim. The drum head includes a one or more sound producing devices that produces one or more distinct sounds. The sound producing device can be a mechanical device and/or electrical devices. The sound producing device can be connected to the top, bottom and/or side of the drum head.

42 Claims, 2 Drawing Sheets

DRUM HEAD HAVING AUXILIARY SOUND PRODUCING DEVICES

This patent application is a continuation of U.S. patent application Ser. No. 09/225,060 filed Jan. 4, 1999, which in turn claims priority on U.S. Provisional Patent Application Ser. No. 60/070,429 filed Jan. 5, 1998 entitled "Drum Head."

The invention pertains to the art of musical instruments and particularly to a drum head. The invention more particularly pertains to an improved drumhead that includes one or more sound producing device attached or connected to the drumhead.

BACKGROUND OF THE INVENTION

Various types of heads for drums have long been known in the art. Drum heads are made of a wide variety of materials such as natural skins, woven natural fibers, and various types of synthetic materials. Presently, the synthetic materials have become the most popular material due to ease of manufacture, and resistance to moisture and temperature changes. Typically, the drum heads are coated with a protective material on one or both sides of the drum head. Such protective materials include adhesives, resins, natural and/or synthetic laminates. These types of drum head are disclosed in Hartry U.S. Pat. No. 4,362,081, which is incorporated herein by reference.

Prior art drum heads provided a single type of sound when struck. Although the prior art drum heads adequately preform their intended function, there is a need for a drum head that can produce a plurality of sounds upon being struck. In the past, a musician has had to employ the use of percussion instruments other than a drum to produce additional percussion sounds. Musical. compositions which incorporate a plurality of simultaneous percussion sounds creates problems for a single percussionist to properly play. In addition to the problem associated with attempting to simultaneously play a plurality of percussion instruments at the same time, there are problems with access to and storage of the percussion instruments which can result in the disruption of play. As a result, the required sounds are not played or a plurality of percussionist must be used. Even when the plurality of sounds are played by a plurality of percussionist, the sounds are not always played simultaneous thus distracting from the quality of the music produced. In view of the prior art drum heads, there is a demand and need for a drum head that can produce a plurality of percussion sound upon being struck and which plurality of percussion sounds occur at the desired moment.

SUMMARY OF THE INVENTION

The invention pertains to an improved drum, and more particularly that produces a plurality of sounds upon striking the drum head of a drum. The invention more particularly pertains to a drum head that includes one or more sound producing devices attached or connected to the top and/or bottom of a drum head.

In accordance with the principal aspect of the present invention, there is provided a drum having a drum head rim and a novel drum head that produces a plurality of distinct sounds when the drum head is struck. The drum head rim is made of any standard material. These materials includes, but are not limited to, metal, wood, plastic, fibreglass, graphite fibers, boron fibers or the like. The drum head rim can be any desired shape or thickness to accommodate a specific use or to produce a specific tone. The drum head rim does not require any special modification to accommodate the novel drum head. The novel drum head is made of any standard material, natural and/or synthetic, that is typically used for drum heads. The drum head preferably includes a woven and/or unwoven material. Preferably the material is a woven material that includes, but is not limited to, natural skins, woven natural fibers, and/or various types of synthetic materials. One preferable material which at least partially makes up the woven material is a synthetic material sold under the mark KEVLAR®. The drum head also preferably includes a natural and/or synthetic protective layer on one or both sides of the woven and/or unwoven material. The protective layer includes, but is not limited to, resins, adhesives, natural and/or synthetic sheet materials, and the like. One preferable protective material which at least partially makes up the protective layer is a synthetic material sold under the mark MYLAR® which is formed into sheets. The protective layer preferably is coated and/or laminated onto the woven and/or unwoven material, however, other mechanisms can be used to connect and/or secure the protective layer to the woven and/or unwoven material. The sound producing device that is secured to the drum to produce one or more sounds is a mechanical and/or electronic device. Preferably the sound producing device produces a sound in response to the drum head being struck. The sound producing device enables the drum upon being struck to produce a plurality of sounds.

In accordance with another aspect of the present invention, the sound producing device produces a sound at a preselected time after the drum and/or drum head has been struck. In one preferred embodiment, the sound producing device produces a sound simultaneously or nearly simultaneously after the drum and/or drum head has been struck In this arrangement, the sound producing device detects and/or responds to sound and/or vibration resulting from the drum and/or drum head being struck The sound producing device upon detection of and/or in response to sound and/or vibration produces a sound. Preferably the sound producing device produces a sound in response to vibration resulting from the drum and/or drum head being struck In another preferred embodiment, the sound producing device produces a sound after the drum and/or drum head has been struck. In this arrangement, the sound producing device detects and/or responds to sound and/or vibration resulting from the drum and/or drum head being struck. The sound producing device upon detection of and/or in response to sound and/or vibration produces a delayed sound after a preselected time. The presented time can be a set time or time that is dependant on the amount of vibration, the volume sound and/or tone of the sound resulting from the drum and/or drum head being struck. In still another preferred embodiment, the sound producing device produces a sound upon detection and/or in respond to a preselected volume, tone and/or quantity of vibration resulting from the drum and/or drum head being struck. The sound producing device upon detection of and/or in response to the preselected volume, tone and/or quantity of vibration produces a sound.

In accordance with still another aspect of the present invention, the sound producing device produces one or more sounds when the drum and/or drum head is struck. The sound producing device enhances the sound of the drum when used. In one preferred embodiment, the sound producing device is a mechanical device. Such mechanical sound producing devices include, but are not limited to, a tambourine jingle, a bell, a bead, a metal ball, a container containing sand, a container containing balls, pipes, cymbal, bar, etc. As can be appreciated, this list is not exclusive, and many other types of mechanical sound producing devices can be used. In another embodiment of the present invention, an electronic sound producing device is attached to the drumhead. The electronic device is preferably produces a sound upon detection and/or in response to vibration, tone and/or sound. Alternatively, or in addition thereto, the electronic sound producing device can be designed to produce a sound upon being struck. In still another preferred embodiment, a plurality of sound producing devices are incorporated on the drum and/or drum head. The sound producing devices may be all mechanical, all electrical or combinations thereof. As can be appreciated, various types of sound producing devices can be used to create different sounds during play.

In accordance with still yet another embodiment of the present invention, the sound producing device is at least partially attached to the drum head of the drum. The sound producing device can be attached to the drum head in a number of ways. Preferably, the sound producing device is attached to the drum head by grommets, adhesive, magnet, string, rods, pins, wire, straw, bolts, screws, clamps, hook and loop fasteners, hook, zipper, snaps, buttons, clips, nails, stitching, etc. As can be appreciated, this list is not exclusive and other mechanisms can be used to attach the sound producing device to the drumhead is within the scope of this invention.

In another embodiment of the present invention, the sound producing device is attached to the drum head. In one preferred embodiment, the sound producing device is attached to the bottom of the drum head to place the sound producing device out plan view and essentially eliminate the obstruction of the surface of the drum head during play. In another preferred embodiment, the sound producing device is attached to the top of the drum head to maximize the volume of the sound producing device during play. In still another preferred embodiment, one or more sound producing devices are positioned on the bottom and top of the drum head. In still yet another preferred embodiment, the placement of the sound producing device on the drum head is selected to obtain a certain type of sound during play. As can be appreciated, the selection of type of sound producing device and positioning of the sound producing device on the drum head can be selected to create a novel drum head that produces a desired type of sound during play The principle object of the present invention is the provision of a drum that produces a plurality of distinct sounds.

Another object of the present invention is the provision of a drum including a sound producing device attached to the drum head.

Still another object of the present invention is the provision of a drum including a mechanical sound producing device attached to the drum head.

Still yet another object of the present invention is the provision of a drum including an electronic sound producing device attached to the drum head.

A further object of the present invention is the provision of a drum including a plurality of sound producing devices connect to the drum head.

Another object of the present invention is the provision of a drum including a sound producing device that produces a distinct sound at a preselected period of time.

Still another object of the present invention is the provision of a drum including a sound producing device that produces a distinct sound after a preselected event.

These and other objects and advantages will become apparent to those skilled in the art upon the reading and following of this description taken together with the accompanied drawing.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE PREFERRED EMBODIMENTS

Figure 1:
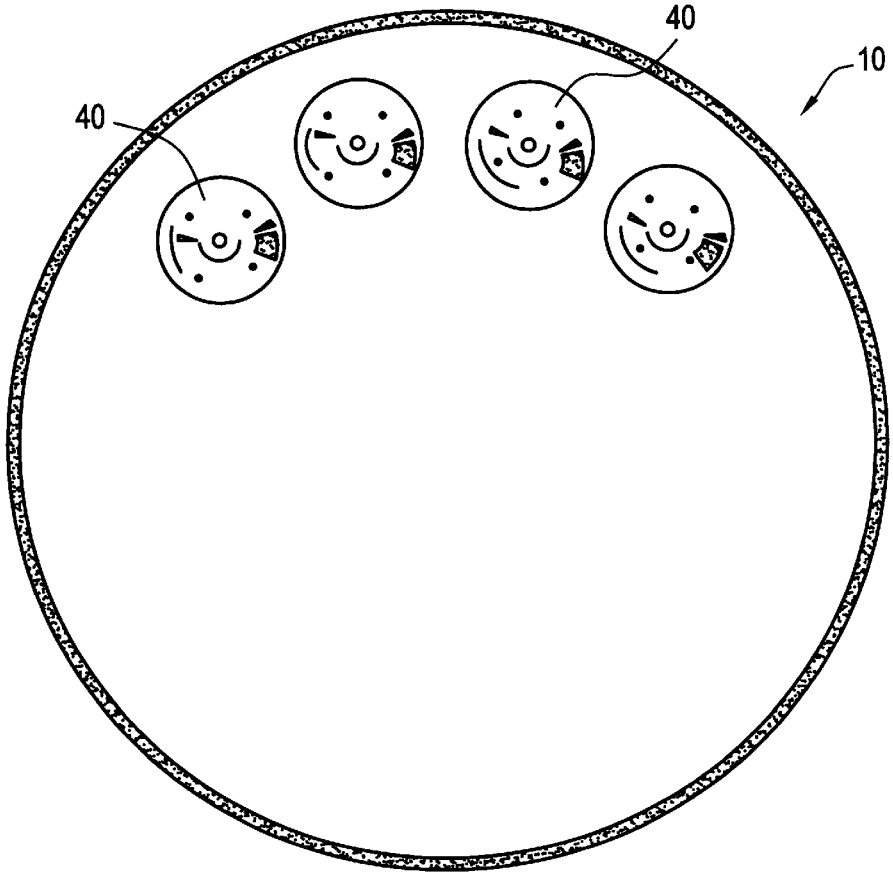
FIG. 1 is a perspective view of a drum head in accordance with the present invention.

Referring now to the drawings, wherein the showings are for the purpose of illustrating the preferred embodiments of the invention only and not for the purpose of limiting the same, in FIG. 1 there is shown a drum head 10 having a plurality of mechanical sound producing devices 40 attached thereto. Four sound producing devices 40 are illustrated as being attached to the drum head. As can be appreciated, more or less sound producing devices can be incorporated on the drum head.

Preferably, one to twenty sound producing devices are used, and more preferably one to six sound producing devices are incorporated on the drum head. The drum head is circular in shape and is designed to fit any one of a number standard drums. In one particular embodiment, the drum head is designed to be attached to a standard snare drum. The drum head is primarily made of synthetic; materials so as to resist damage from moisture and to resist tonal changes due to temperature fluxes. The sound producing devices 40 are designed to produce a distinct sound in response to drum head 10 being struck by a drum stick, hand or other device.

As illustrated in FIG. 1, the plurality of sound producing devices 40 are positioned closely adjacent to the peripheral edge of the drum head. In particular, four sound producing devices 40 are positioned closely together and positioned closely adjacent to the drum head rim 20. This arrangement exposes a majority of the drum head surface to the player thereby reducing the chance of inadvertently striking the sound producing devices during play. As can be appreciated, the sound producing devices can be positioned anywhere on the drum head to minimize or maximized the chance that a particular sound producing device is struck during play.

Figure 3:
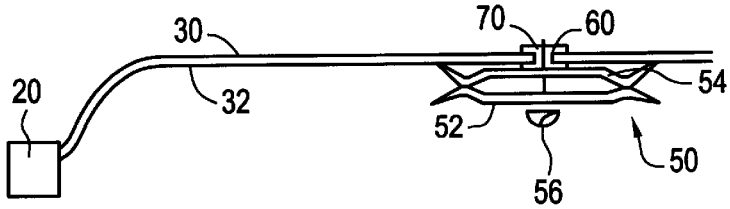
FIG. 3 is a partial cross-section view of another embodiment of the drum head of the present invention.
Figure 2:
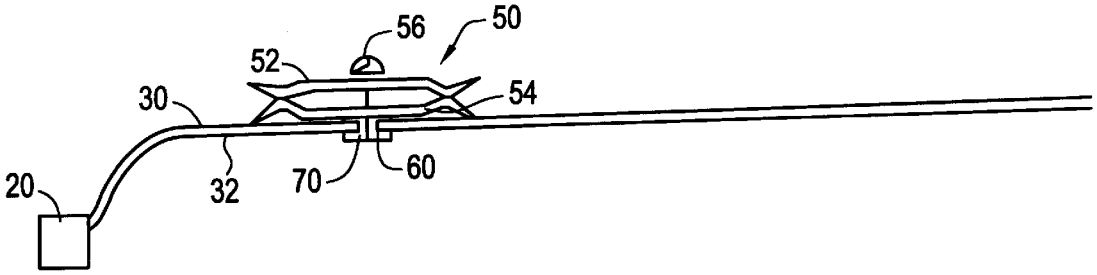
FIG. 2 is a partial cross-section view of one embodiment of the drum head of the present invention.

Referring now to FIG. 2, a cross-sectional portion of the drum head is illustrated. A jingle 50 is illustrated as being connected to drum head top surface 30 of drum head 10. Jingle 50 is a standard two piece jingle having a top jungle portion 52 and a bottom jingle portion 54. The two jingle portions are connected together by a pin 56. The size and shape of the jingle portions can be modified to produce a desired sound. Pin 56 is illustrated as passing though jingle portions 52 and 54 and into a grommet 70. Grommet 70 is designed to connect jingle 50 to the drum head 10. As illustrated in FIG. 2, grommet 70 attaches jingle 50 to top surface 30 of drum head 10. In FIG. 3, grommet 70 attaches jingle 50 to bottom surface 32 of drum head 10. The grommet is secured in drum head opening 60. The grommet is designed to secure the pin of jingle 50 in place in the drum head opening. The grommet is also designed to protect drum head opening 60 from damage during play. The grommet also spaces the jingles from the surface of the drum head as to obtain the desired sound from the jingle. The jingle is a mechanical sound producing device that produces a ringing sound when the jingle and/or the drum head is struck. The ringing sound formed by the jingle in combination with the sound produced by the drum head forms the plurality of sounds from the novel drum head.

Figure 4:
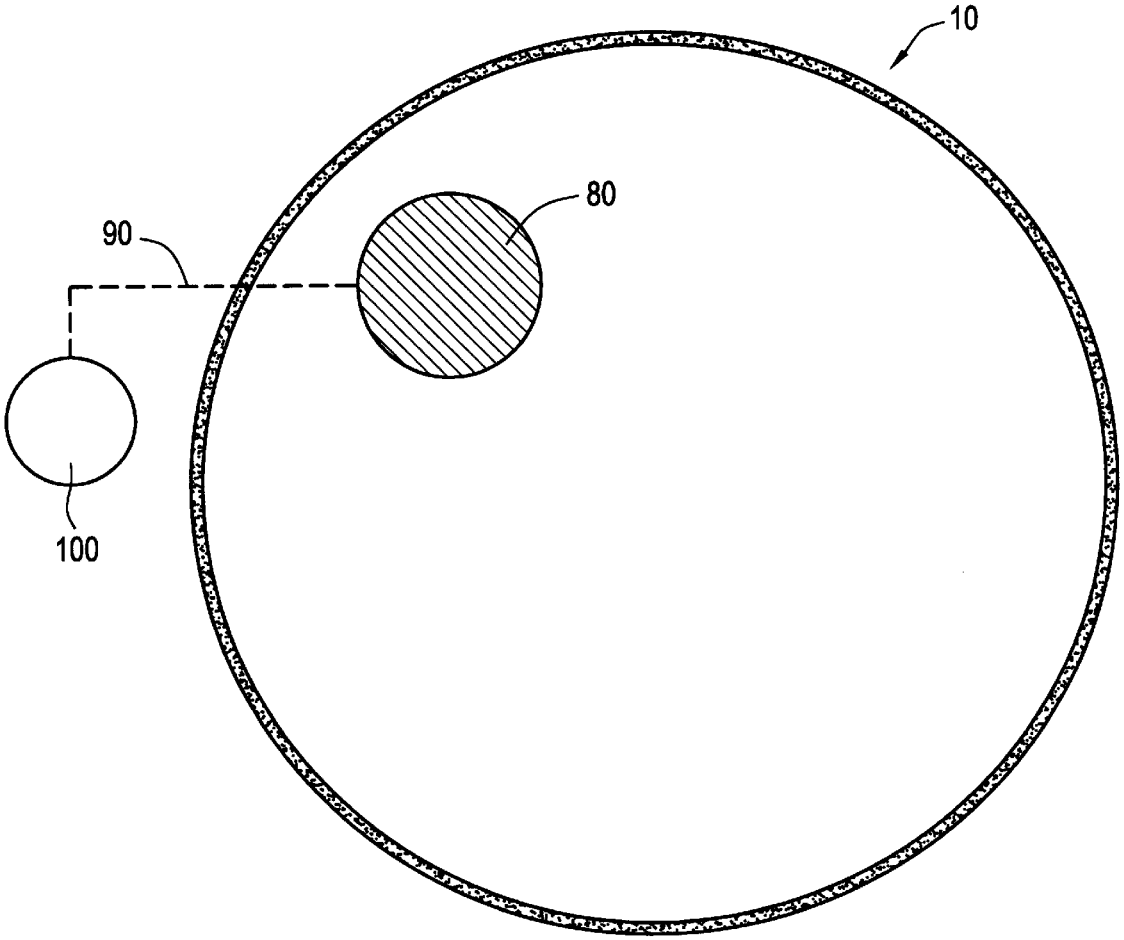
FIG. 4 is a perspective view of a drum head in accordance with the present invention.

Referring now to FIG. 4, drum head 10 is illustrated as including an electronic sound producing device 80. The electronic sound producing device produces a sound upon detection and/or in response to vibration, in response to a certain tone, in response to a certain sound, and/or upon being struck. The electronic sound producing device can be designed to produce a single or plurality of sounds. The electronic sound producing device can also be designed to produce a varying sound or sounds each time the electronic sound producing device is activated. As can be appreciated, one or more electronic sound producing devices can be attached to the drum head. Furthermore, the electronic sound producing device can be attached to the top and/or bottom of the drum head.

Electronic sound producing device 80 is connected to a sound processor 100 by wire 90. Sound processor 100 can be incorporated in electronic sound producing device 80 or be a separate component. Sound processor 100 can be a speaker, amplifier, equalizer, etc.

In summary, the novel drum head is based upon the inclusion of a sound producing device on a drum head. The sound producing device can be mechanical and/or electrical. One or more sound producing devices can be attached to the drum head. The sound producing device can be positioned on the top, bottom and/or side of the drum head.

The invention has been described with reference to preferred embodiments and alternatives thereof. It is believed that many modification and alterations to the embodiments disclosed will readily suggest themselves to those skilled in the art upon reading and understanding the description of the invention and drawings of the invention. It is intended to include all such modifications and alterations insofar as they come within the scope of the present invention.

I claim:

1. A percussion instrument comprising a drum head rim, a material having a top and bottom side secured to said rim, and at least one mechanical sound producing device directly connected to said material by a connector, said connector spaced inwardly of said rim and penetrating through said material, said mechanical sound producing device producing an audible, unamplified sound when said material is struck.

2. A percussion instrument as defined in claim 1, wherein a plurality of mechanical sound producing devices are connected to said material.

3. A percussion instrument as defined in claim 2, wherein said mechanical sound device includes a jingle.

4. A percussion instrument as defined in claim 3, wherein said mechanical sound device includes a plurality of jingles.

5. A percussion instrument as defined in claim 1, wherein said mechanical sound producing device is connected to the top of said material.

6. A percussion instrument as defined in claim 4, wherein at least one of said mechanical sound producing device is connected to the top of said material.

7. A percussion instrument as defined in claim 1, wherein said mechanical sound producing device is connected to the bottom of said material.

8. A percussion instrument as defined in claim 6, wherein at least one of said mechanical sound producing device is connected to the bottom of said material.

9. A percussion instrument as defined in claim 1, wherein said connector is a grommet.

10. A percussion instrument as defined in claim 8, wherein said connector is a grommet.

11. A percussion instrument comprising a rim, a material secured to said rim, and at least one electronic sound producing device directlu connected to said material by a connector, said connector spapced inwardly of said rim, said electronic sound producing device producing a sound at a preselected time after said device detects said material vibrating or detects sound generated from said material.

12. A percussion instrument as defined in claim 11, wherein a plurality of electronic sound producing devices are connect to said material.

13. A percussion instrument as defined in claim 11, wherein said sound producing device is connected to the bottom of said material.

14. A percussion instrument as defined in claim 11, wherein said sound producing device is connected to the bottom of said material.

15. A percussion instrument as defined in claim 11, including a mechanical sound producing device.

16. A percussion instrument as defined in claim 15, wherein said mechanical sound producing device is a jingle.

17. A percussion instrument as defined in claim 16, wherein said mechanical sound producing device includes a plurality of jingles.

18. A percussion instrument as defined in claim 15, wherein said mechanical sound producing device is directly connected to said material by a connector, said connector spaced inwardly of said rim.

19. A percussion instrument as defined in claim 18, wherein said connector for said mechanical sound producing device penetrates through said material.

20. A percussion instrument as defined in claim 19, wherein said connector for said mechanical sound producing device is a grommet.

21. A percussion instrument as defined in claim 1, wherein said mechanical sound producing device is positioned closely adjacent to said rim.

22. A precussion instrument as defined in claim 2, wherein at least two of said plurality of mechanical sound producing devices are positioned closely adjacent to said rim.

23. A precussion instrument as defined in claim 7, wherein at least two of said plurality of mechanical sound producing devices are positioned closely adjacent to said rim.

24. A precussion instrument as defined in claim 10, wherein at least two of said plurality of mechanical sound producing devices are positioned closely adjacent to said rim.

25. A percussion instrument as defined in claim 22, wherein two adjacently positioned mechanical sound producing devices are positioned at substantially an equal distance from said rim.

26. A percussion instrument as defined in claim 23, wherein two adjacently positioned mechanical sound producing devices are positioned at substantially an equal distance from said rim.

27. A percussion instrument as defined in claim 24, wherein two adjacently positioned mechanical sound producing devices are positioned at substantially an equal distance from said rim.

28. A percussion instrument as defined in claim 2, wherein at least four mechanical sound producing devices are positioned closely adjacent to one another.

29. A percussion instrument as defined in claim 25, wherein at least four mechanical sound producing devices are positioned closely adjacent to one another.

30. A percussion instrument as defined in claim 26, wherein at least four mechanical sound producing devices are positioned closely adjacent to one another.

31. A percussion instrument as defined in claim 27, wherein at least four mechanical sound producing devices are positioned closely adjacent to one another.

32. A percussion instrument as defined in claim 9, wherein said grommet spaces said mechanical sound producing device from the surface of said material.

33. A percussion instrument as defined in claim 29, wherein said grommet spaces said mechanical sound producing device from the surface of said material.

34. A percussion instrument as defined in claim 30, wherein said grommet spaces said mechanical sound producing device from the surface of said material.

35. A percussion instrument as defined in claim 31, wherein said grommet spaces said mechanical sound producing device from the surface of said material.

36. A percussion instrument comprising a drum head rim, a material secured to said rim, and a plurality of jingles directly connected to a top side of said material by connectors, said connectors spaced inwardly of said rim, said jingles are positioned closely adjacent to said rim, said jingles producing an audible, unamplified sound when said material is struck.

37. A percussion instrument as defined in claim 36, wherein at least one jingle is connected to a bottom side of said material.

38. A percussion instrument as defined in claim 36, wherein said connectors are grommets that penetrates through said material.

39. A percussion instrument as defined in claim 37, wherein said connectors are grommets that penetrates through said material.

40. A percussion instrument as defined in claim 39, wherein at least two adjacently positioned jingles are positioned at substantially an equal distance from said rim.

41. A percussion instrument as defined in claim 40, where four jingles are positioned closely adjacent to one another.

42. A percussion instrument as defined in claim 41, wherein said grommets spaces said jingles from the surface of said material.

* * * * *